United States Patent [19]

Rubin

[11] Patent Number: 4,766,732

[45] Date of Patent: Aug. 30, 1988

[54] CHAMBER REFRIGERATED BY SOLID CARBON DIOXIDE

[76] Inventor: Julius Rubin, 54 Madison Ave., Franklin Square, N.Y. 11010

[21] Appl. No.: 112,363

[22] Filed: Oct. 26, 1987

[51] Int. Cl.[4] ..... F25D 25/00

[52] U.S. Cl. ..... 62/62; 62/384; 62/388; 62/457

[58] Field of Search ..... 62/384, 388, 457, 62

[56] References Cited

U.S. PATENT DOCUMENTS

| | | | |
|---|---|---|---|
| 2,636,357 | 4/1953 | Woods | 62/384 |
| 3,561,226 | 2/1971 | Rubin | 62/388 |
| 4,644,754 | 2/1987 | Gibot | 62/384 |

*Primary Examiner*—Ronald C. Capossela
*Attorney, Agent, or Firm*—Paul W. Garbo

[57] ABSTRACT

A chamber for keeping perishable material, either liquid or solid, under refrigeration is provided with a tubular metal container that can be filled with pressurized liquid carbon dioxide. When the pressure in the container holding liquid carbon dioxide is dropped to atmospheric pressure, approximately half of the liquid flashes off as vapor and half becomes solid. The container is disposed along the top of the chamber so that refrigeration from solid carbon dioxide therein flows through the chamber by convection currents. Carbon dioxide vapor may flow from the container into the chamber to provide a protective atmosphere for the material therein.

18 Claims, 2 Drawing Sheets

CHAMBER REFRIGERATED BY SOLID CARBON DIOXIDE

BACKGROUND OF THE INVENTION

This invention relates to refrigeration for stationary and transportable compartments or containers used to prevent deterioration or spoilage of farm produce, food products and other perishable materials in either solid or liquid form. More particularly, the invention involves refrigeration apparatus utilizing solid carbon dioxide ($CO_2$) as the refrigerant and the method of charging pressurizable apparatus with liquid $CO_2$ at elevated pressure to provide a pool of liquid $CO_2$ therein and converting the liquid pool to solid cake or block form.

In spite of the extensive use of mechanical refrigeration systems with storage rooms and vehicles designed for perishable goods, there has been a growing realization that refrigeration from $CO_2$ offers several advantages over mechanical refrigeration. For instance, $CO_2$ refrigeration avoids the danger of unexpected mechanical failure, requires lower capital and maintenance costs, and eliminates dependence on a fuel subject to large cost variations.

A simple and effective $CO_2$ refrigeration system which has gained increasing acceptance for boxcars is disclosed and claimed in the present inventor's U.S. Pat. No. 3,561,226. The patented system which has also been applicable to trucks involves spraying pressurized liquid $CO_2$ into an atmospheric box whereupon the sprayed liquid $CO_2$ becomes flakes. The $CO_2$ flakes accumulate in the box much like snow forms a mass or blanket on the ground. As known, such masses of flakes have very low density. Obviously, it would be advantageous to store in the refrigeration system $CO_2$ as a solid of high density so that more refrigeration could be stored per unit of volume in the truck or other container requiring refrigeration. The aforesaid patented system of filling an atmospheric cold box with $CO_2$ flakes depends upon the flashing or vaporization of roughly half of the liquid $CO_2$ which is sprayed. Hence, the resulting $CO_2$ vapor which contributes little refrigeration to the boxcar or truck before escaping therefrom into the atmosphere is largely an economic loss.

An improved $CO_2$ refrigeration system for preserving perishable goods and liquids in containers has now been designed to optimize its refrigeration capacity and uniformity as well as to increase its economic attractiveness.

A principal object of this invention is to provide a $CO_2$ refrigeration system in which a solid cake of $CO_2$ is formed as the refrigerant.

A further object is to recover $CO_2$ vapor evolved when charging the refrigeration system with solid $CO_2$ or when draining the system of residual $CO_2$ prior to a shutdown or disuse period.

Other features and advantages of the invention will be apparent from the description which follows.

SUMMARY OF THE INVENTION

In accordance with this invention, pressurized liquid $CO_2$, generally in the range of about 215 to 305 pounds per square inch absolute (psia) and temperature range of about −20° to 0° F., is introduced into a cold box having one or more horizontal tubes maintained at a pressure which at its lowest level will be slightly above the triple point of $CO_2$, say above 76 psia, until each tube is filled nearly to capacity whereupon the introduction of liquid $CO_2$ is stopped and the pressure in the tube or tubes is reduced to atmospheric pressure or slightly above it with the result that $CO_2$ vapor is flashed off and the temperature of the remaining liquid drops sufficiently to convert the liquid to solid $CO_2$. Approximately half of the weight of liquid $CO_2$ supplied to a tube is vaporized; this cold vapor can be used to cool the container and the perishable goods therein or returned to a liquefaction plant for conversion into liquid $CO_2$. The remaining liquid which becomes solid $CO_2$ in a tube will occupy the lower portion thereof, leaving the upper portion free to receive an additional supply of pressurized liquid $CO_2$. The solid $CO_2$ first formed in a tube may be spongy but the second introduction of pressurized liquid $CO_2$ will permeate the spongy solid as well as occupy the free upper space in the tube. Again, the pressure in the tube is reduced to about atmospheric pressure so that $CO_2$ vapor is flashed off and roughly half of the weight of the second addition of liquid $CO_2$ becomes solid $CO_2$. The first formation of solid $CO_2$ in the tube which may have been spongy is not only made denser but also increased in quantity by the second addition of liquid $CO_2$. Usually, a third addition of pressurized liquid $CO_2$ followed by flash vaporization is the practical limit of charging a horizontal tube with solid $CO_2$. Some free space remains above the solid $CO_2$ so that $CO_2$ vapor evolving therefrom is free to flow out of the horizontal tube.

For a clearer understanding of what happens with each successive introduction of pressurized liquid $CO_2$ into a tube, an illustrative example follows. Assuming the first addition of pressurized liquid $CO_2$ to a tube is at 305 psia and temperature of 0° F., when the pressure is reduced to about atmospheric pressure each pound of liquid $CO_2$ becomes roughly 0.5 pound of solid $CO_2$ with a temperature of about −109° F. and about 4.4 standard cubic feet of $CO_2$ vapor with the same low temperature. Each pound of the second addition of the pressurized liquid $CO_2$, after the pressure is dropped to atmospheric, will turn into slightly more than 0.5 pound of solid $CO_2$ with a temperature of about −109° F. and slightly less than about 4.4 standard cubic feet of $CO_2$ vapor. Each pound of the third addition of pressurized liquid $CO_2$, after the pressure is reduced to atmospheric, will be converted to slightly more than 0.5 pound of solid $CO_2$ and slightly less than 4.4 standard cubic feet of $CO_2$ vapor.

As another example of forming a solid cake of $CO_2$ in the metal tubular cold box of this invention, liquid $CO_2$ at a pressure of 215 psia and temperature of −20° F. is introduced into the tubular cold box equipped with an expansion valve at the inlet port and with a back pressure control valve at the outlet port set to maintain in the cold box a pressure slightly above the triple point, e.g., 79 psia. The flow of pressurized liquid $CO_2$ into the cold box is stopped when the liquid $CO_2$ level is about to enter the vapor outlet port.

A device which will detect when that liquid level has been reached and which can be electronically wired so that the liquid $CO_2$ inlet valve will be automatically closed is the Gasminder Liquid/Gas Sensor sold by the Distillers Company (Carbon Dioxide) Limited of Reigate, England. This device may be installed near the vapor outlet of the cold box so that when the liquid $CO_2$ level contacts the sensor it will give an audible or visual alarm and/or cause the automatic stoppage of liquid $CO_2$ flow into the tubular cold box.

When the flow of pressurized liquid $CO_2$ into the cold box has been stopped, a control valve in the vapor vent pipe is opened to drop the pressure from 79 psia to atmospheric pressure. Thereupon, about one-third of the weight of liquid $CO_2$ in the cold box flashes into vapor which is vented from the cold box while the remainder of the liquid becomes a solid cake of $CO_2$. A second introduction of liquid $CO_2$ at a pressure of 215 psia and a temperature of −20° F. into the cold box containing solid $CO_2$ and maintained at 79 psia is again stopped when the level of liquid $CO_2$ is about to enter the vapor vent pipe. At this point, the control valve in the vent pipe is again opened to vent to the atmosphere about one-third of the weight of the second addition of liquid $CO_2$ as vapor. The remainder of the second addition of liquid $CO_2$ becomes solid $CO_2$ thereby increasing the solid $CO_2$ first formed in the cold box. Under the conditions of this example, the two successive introductions of pressurized liquid $CO_2$ into the cold box produce a solid dense cake of $CO_2$ having a high enough level in the metal tubes of the cold box that a third addition of liquid $CO_2$ is rarely justified.

The metal tubes used as the cold box of this invention may have any desired diameter but especially for use in railroad cars and trucks the preferred diameter range is about 4 to 6 inches. Aluminum tubes are preferred for many installations although tubes made of stainless steel, copper and various alloys may also be used. Generally, the cold box will have several tubes in a parallel and abutting arrangement with common headers at their opposite ends. One header may serve for the introduction of pressurized liquid $CO_2$ into the tubes and the other header for the discharge of $CO_2$ vapor.

The cold box is generally installed along the top of the compartment or container which is going to be refrigerated so that the atmosphere or vapor in the free space in the container, which is chilled upon contacting the surface of the cold box, will naturally flow downward to the goods or liquid in the container because of its increased density and thence will rise toward the cold box. In short, natural convection currents carry refrigeration from the surface of the cold box to the material below that is to be chilled. Inasmuch as solid $CO_2$ sublimes at atmospheric pressure at a temperature of about −109° F. and most perishable goods are best kept at higher temperatures, such as 30° to 40° F. for fresh fruit, vegetables and milk or lower temperatures down to about 0° F. for frozen foods, insulation is usually applied to the exterior of the tubes. Of course, the amount of insulation applied to the tubes is determined by the lowest temperature permitted for a given installation. For example, the exposed surface of the insulation may be at an acceptable temperature of −5° F. in one case but better insulation will be required in another case where the acceptable surface temperature must not be below 10° F. When the container holds goods not adversely affected by contact with $CO_2$ vapor, the cold vapor leaving the cold box may be vented into the container to help chill the goods.

BRIEF DESCRIPTION OF THE DRAWINGS

To facilitate the further description and understanding of the invention, reference will be made to the accompanying drawings of which.

DESCRIPTION OF PREFERRED EMBODIMENTS

Figure 1:
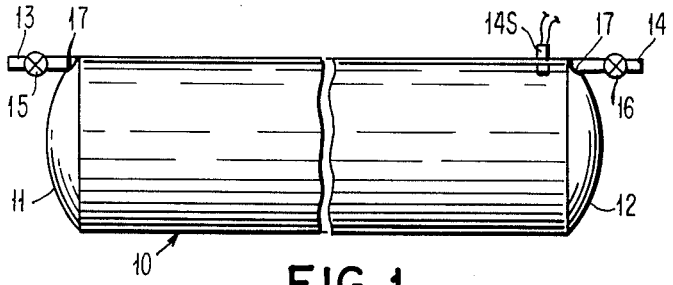
FIG. 1 is a diagrammatic side view of tube which is illustrative of the basic component of the cold box of the invention.

FIG. 1 is a side view of tube 10 which is the basic component of the cold box of this invention and which is generally installed close to the top of the chamber or tank to be refrigerated. Opposite ends 11,12 are closed but have pipes 13,14 connected at their topmost portions to permit the flow of fluid into or out of tube 10. Pipes 13,14 have valves 15,16 to control fluid flow into and out of tube 10. In accordance with this invention, tube 10 will provide refrigeration in the chamber or tank in which it has been installed when solid $CO_2$ has been deposited therein.

Figure 2:
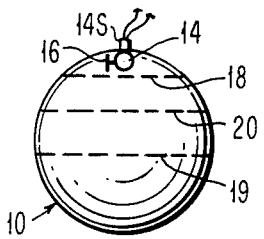
FIG. 2 is an end view of the tube of FIG. 1.

In the procedure for forming solid $CO_2$ in tube 10, it will be assumed that pipe 13 is the supply end of tube 10 and pipe 14 is the exhaust end. Of course, the roles of pipes 13, 14 can be reversed. With valve 14 closed and valve 13 open, pressurized liquid $CO_2$ is introduced into tube 10 until the liquid level therein is at about the bottom 17 of horizontal pipes 13,14 whereupon valve 13 is closed. Preferably, tube 10 would be equipped with remote liquid level control-sensor 14S which would automatically close the flow of liquid $CO_2$ into tube 10 when the liquid level reached the bottom 17 of pipes 13,14. Valve 16 is then opened to reduce the pressure in tube 10 to about atmospheric pressure. The drop in pressure causes $CO_2$ vapor to be flashed off and vented through pipe 14 so that the temperature of the remaining liquid originally in the range of about −20° to 0° F. drops to about −109° F. In the end view of tube 10 as shown in FIG. 2, dotted line 18 corresponds to the bottom 17 of horizontal pipes 13,14 and indicates the level of liquid $CO_2$ in tube 10 when valve 15 is closed. When valve 16 is opened to reduce the pressure in tube 10, $CO_2$ vapor is evolved and escapes through pipe 14 and the residual liquid $CO_2$ turns to solid $CO_2$ filling the lower portion of tube 10 to about level 19. Valve 16 is then closed and valve 15 is again opened to introduce pressurized liquid $CO_2$ until liquid level 18 is reached when valve 15 is closed and valve 16 is opened. The $CO_2$ vapor emanating from the liquid with the pressure reduction exits tube 10 through pipe 14 and the increased solid $CO_2$ deposit, now at a temperature of about −109° F., fills tube 10 to about level 20. Generally, a third addition of liquid $CO_2$ is made by closing valve 16 and opening valve 15 until liquid level 18 is reached. Then valve 15 is again closed and valve 16 is opened. The evolution of $CO_2$ vapor at this stage further increases the solid $CO_2$ deposit, filling tube 10 to a level between levels 18,20.

A small fourth addition of liquid $CO_2$ can be made but is in most cases not justified. Conversely, it is not necessary in all cases to maximize the deposition of solid $CO_2$ in tube 10; only two or even one filling of tube 10 with pressurized liquid $CO_2$ may suffice to produce the solid $CO_2$ required to provide refrigeration for a brief period, say 2 or 3 days. By contrast, when tube 10 has been filled with solid $CO_2$ to nearly level 18, it will continue to provide refrigeration in an insulated chamber for a week or longer. When the formation of solid $CO_2$ to any desired level in tube 10 has been completed, and the pressurized liquid $CO_2$ supply hose has been disconnected from pipe 13, valve 15 may be left closed and valve 16 may be left open, or vice versa, or both valves 15,16 may be open. It is preferable that a pressure slightly below the triple point (75 psia) be maintained in tube 10 when venting $CO_2$ vapor therefrom. Hence, it is advisable to have a pressure relief valve (not shown) in line 14 which can be set to release $CO_2$ vapor from tube 10 when valve 16 is open and the pressure in tube 10 exceeds a chosen pressure, e.g., 70 psia. Of course, tube 10 will provide refrigeration without maintaining any back pressure so that $CO_2$ vapor generated from the solid $CO_2$ will flow out of tube 10 at atmospheric pressure.

Heat warming tube 10 causes the solid $CO_2$ therein to generate cold $CO_2$ vapor which in many cases is permitted to flow from pipe 14 directly into the enclosure or chamber that has tube 10 suspended adjacent its ceiling. The cold $CO_2$ vapor dropping down through the chamber not only refrigerates the products stored in the chamber but also provides a $CO_2$-rich atmosphere which is beneficial when the products tend to deteriorate in air. A $CO_2$-rich atmosphere is desirable to maintain freshness in many fruits and vegetables stored in a refrigerated compartment. If in a particular case $CO_2$ vapor is undesirable within the refrigerated chamber, pipe 14 is extended so that it passes through a wall of the chamber and discharges $CO_2$ vapor into the outside atmosphere.

Figure 3:
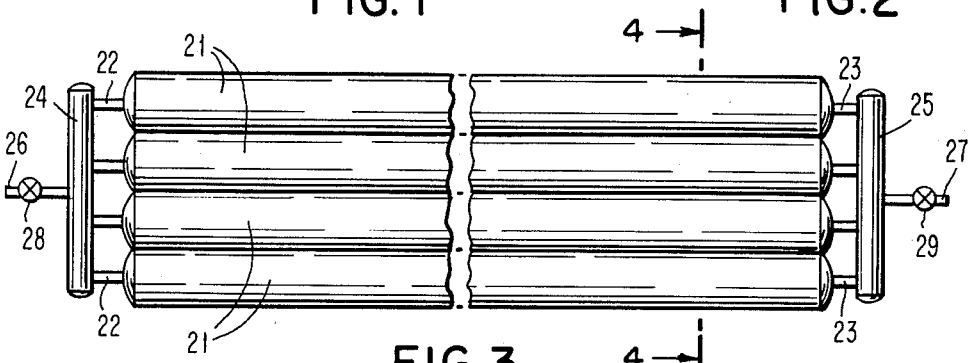
FIG. 3 is a top view of four tubes arranged in parallel and connected to headers at their opposite ends so as to function as a single tube.

In general, the cold box of this invention will have a multiplicity of tubes like tube 10 of FIG. 1. FIG. 3 shows a bank of four tubes 21 with pipes 22,23 at their opposite ends connected to headers 24,25, respectively. Pipes 26,27 connected to headers 24,25 have valves 28,29 to control fluid flow into or out of tubes 21. The procedure for forming a deposit of solid $CO_2$ simultaneously in all four tubes 21 is the same as that explained for tube 10 of FIG. 1. Thus, if pipe 26 is selected for supplying liquid $CO_2$, valve 29 is closed and valve 28 is opened. Pressurized liquid $CO_2$ flows from pipe 26 into header 24 and thence through pipes 22 to tubes 21 until the level of liquid $CO_2$ in tubes 21 is at the bottom of pipes 22. Valve 28 is then closed and valve 29 is opened to atmospheric pressure. The $CO_2$ vapor evolved by the reduction of pressure discharges through pipe 29 and the remainder of the liquid $CO_2$ becomes solid $CO_2$ in the lower portion of tubes 21. Second and third additions of liquid $CO_2$ to tubes 21 for conversion into solid $CO_2$ by flashing vapor from the liquid pool with pressure reduction can be made depending on how near to maximum capacity of solid $CO_2$ is desired.

Figure 4:
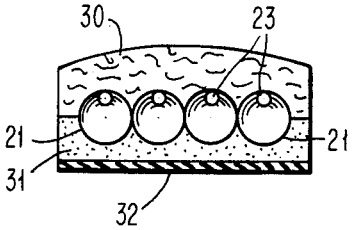
FIG. 4 is a sectional view of the four tubes taken along line 4—4 of FIG. 3 to which insulation has been applied.

FIG. 4 is a sectional view of tubes 21 of FIG. 3 to which insulation has been added. The upper portion of tubes 21 is covered with insulation 30 to minimize the loss of refrigeration from tubes 21 to the ceiling or roof of the chamber in which the cold box is installed. As shown, the top of insulation 30 is curved to fit against the roof of a railroad car. The lower portion of tubes 21 is covered with insulation 31 which is selected to give an exposed surface temperature above the very low temperature of solid $CO_2$ in tubes 21 but still low enough to refrigerate the contents of the railroad car. For different products, different levels of refrigeration may be desirable. For example, insulation 31 may be selected to maintain a temperature of about 0° F. when frozen food is to be transported in the railroad car but when apples or lettuce are to be transported the temperature should be about 35° F. In such case, an insulation panel 32 may be placed against insulation 31 to raise the temperature in the car.

Figure 5:
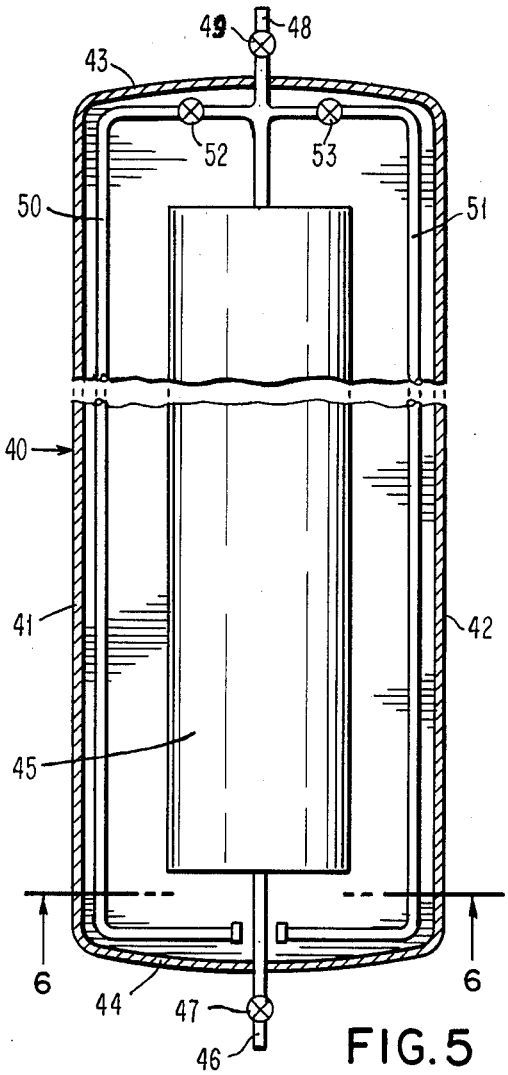
FIG. 5 is a diagrammatic top view of a railroad car from which the roof and undercarriage have been omitted and in which the cold box of this invention has been installed.

FIG. 5 is a schematic top view of a railroad car, the roof of which has been omitted to simplify showing the refrigeration apparatus of this invention. Car 40 with side walls 41,42 and end walls 43,44 holds cold box 45 adjacent its roof. Cold box 45 is the same as the four tubes 21 shown in FIG. 3 and FIG. 4. Pipe 46 for supplying liquid $CO_2$ to cold box 45 passes through end wall 44 and has valve 47 outside car 40. The opposite end of cold box 45 has pipe 48 extending through end wall 43. Valve 49 in pipe 48 is used to control the venting of $CO_2$ vapor from cold box 45. Within car 40, two branch pipes 50,51 are connected to pipe 48 and have remote control valves 52,53. Branch pipe 50 is disposed along end wall 43, side wall 41 and end wall 44 while branch pipe 51 runs along end wall 43, side wall 42 and end wall 44. The bottom portions of branch pipes 50,51 have a series of spaced perforations so that, after cold box 45 has been charged with solid $CO_2$ and valves 47,48 have been closed and valves 52,53 have been opened, cold $CO_2$ vapor evolved in cold box 45 will flow through pipe 48 into branch pipes 50,51, issuing therefrom through the perforations. The multiplicity of cold $CO_2$ vapor streams escaping from branch pipes 50,51 drop down along side walls 41,42 and end walls 43,44 to fill car 40 with a cool $CO_2$-rich atmosphere.

Figure 6:
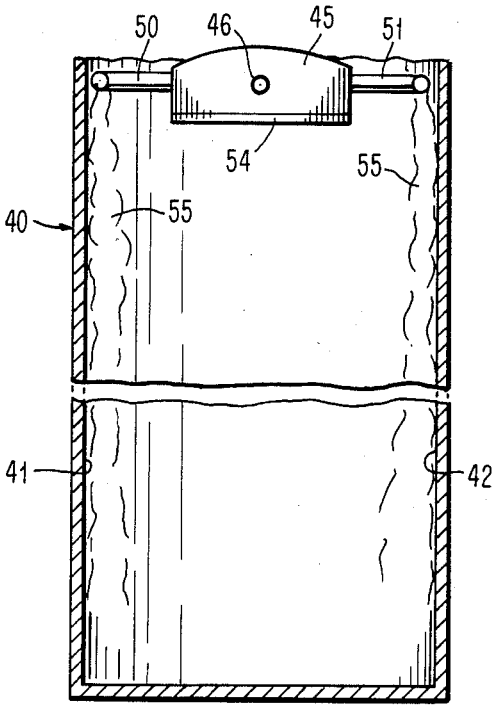
FIG. 6 is a sectional view taken along line 6—6 of FIG. 5.

FIG. 6 is a sectional view of railroad car 40 of FIG. 5. Cold box 45 is shown with insulation panel 54 which can be removed when a lower temperature is required in car 40. Dotted lines 55 are used to indicate the streams of cold $CO_2$ vapor escaping through the spaced perforations along the bottom portions of branch pipes 50,51.

To load cold box 45, valves 49,52,53 are closed and valve 47 is opened to receive pressurized liquid $CO_2$ from a supply tank (not shown). As previously explained, valve 47 is closed when the liquid level in the tubes of cold box 45 is about to enter pipe 48. With valves 47,52,53 closed, valve 49 is opened to drop the pressure in cold box 45 and discharge $CO_2$ vapor flashed from the liquid $CO_2$. Preferably, $CO_2$ vapor is passed from pipe 48 to a plant which will compress the vapor to raise its pressure back to 305 psia and will chill the compressed vapor to a temperature of 0° F. The resulting liquid $CO_2$ is obviously available for supplying cold box 45. When such a $CO_2$ recovery plant is not available, valve 49 is kept closed and remote valves 52,53 are opened so that cold $CO_2$ vapor flows into branch pipes 50,51 from which it escapes through their many perforations into car 40. In the event that the product to be transported in car 40 will deteriorate or be harmed by a $CO_2$-rich atmosphere, valves 52–53 would be kept closed and valve 49 would be opened to vent $CO_2$ vapor directly to the outside atmosphere.

Figure 7:
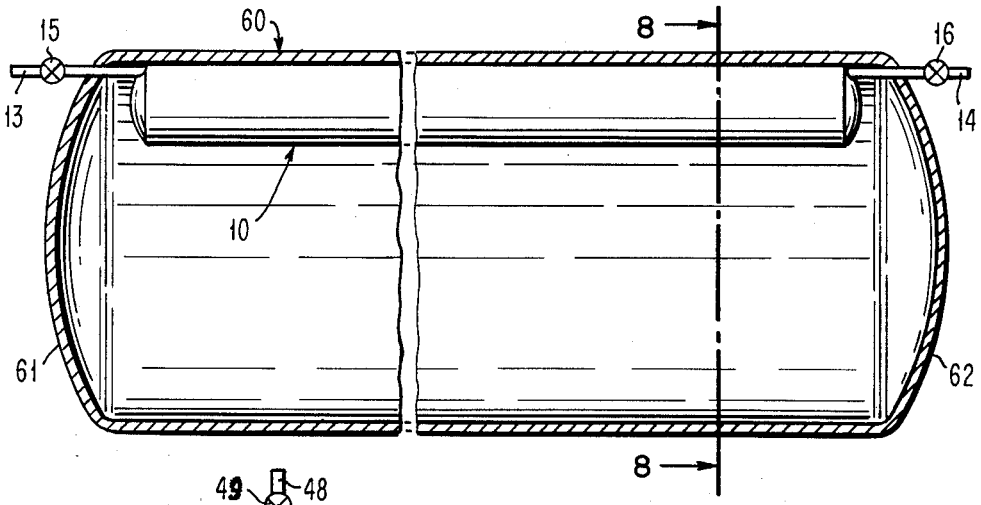
FIG. 7 is a diagrammatic sectional side view of a liquid tank which contains the tubular cold box of FIG. 1.
Figure 8:
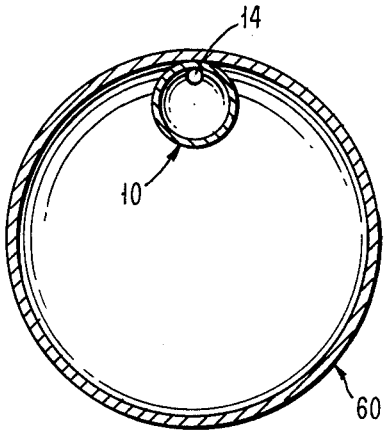
FIG. 8 is a sectional view taken along line 8—8 of FIG. 7.

FIGS. 7 and 8 schematically illustrate a large cylindrical tank 60 in which tubular cold box 10 of FIG. 1 is set to provide refrigeration to a perishable liquid, such as milk or fruit juice, stored in tank 60. Tank 60 may be supported on a stationary foundation at a processing plant for that liquid or it may be mounted on a conventional carriage for transportation by railroad or highway. As shown, pressurizable tube 10 is disposed along the topmost part of tank 60 with its two pipes 13,14 extending through ends 61,62 of tank 60. Valves 15,16 in pipes 13,14 are also outside tank 60. It will be noted that $CO_2$ vapor evolved in tube 10 is vented directly to the atmosphere. Venting $CO_2$ vapor into tank 60 where it would contact the liquid is very rarely permissible.

Of course, tank 60 is insulated to minimize heat leak into tank 60 and its liquid content and tube 10 is also insulated as hereinbefore described so that the exterior surface of the insulation on tube 10 is at a temperature which will not cause freezing of the liquid in tank 60. Usually, the exterior surface of the insulation on tube 10 has a thin metal (e.g., aluminum or stainless steel) sheath which can be scrubbed or otherwise cleaned.

The schematic drawings of FIGS. 7 and 8 do not show the manhole for entering and cleaning tank 60 as well as the ports for introducing and draining the liquid of tank 60 inasmuch as such elements are standard components of tank 60 and are not part of this invention.

When tank 60 is filled to capacity the liquid will contact the sheathed, insulated cold box or tube 10 and will be chilled by refrigeration from the solid block of $CO_2$ formed in tube 10 as hereinbefore described. The liquid thus chilled having a greater density will naturally descend toward the bottom of tank 60 while the somewhat warmer liquid will rise from the bottom and thus form natural convection currents in the liquid body tending to equalize temperatures therein. Of course, if tank 60 is transported by railroad or truck, the liquid will be agitated by the movement of tank 60 so that temperature equalization of the liquid is enhanced. Even when the liquid level in tank 60 is below the lowermost portion of sheathed, insulated tube 10, the liquid will be chilled by natural convection currents of the gas or vapor in tank 60 circulating between cold box 10 and the liquid below.

If the pressurized liquid $CO_2$ supplied to the metal container pursuant to this invention is subcooled, less $CO_2$ vapor is flashed from the liquid pool in the container when the pressure is dropped below the triple point of $CO_2$. Thus, if liquid $CO_2$ at a pressure of 305 psia which normally has a temperature of 0° F. is subcooled 10° F. or more, when the pressure of the subcooled liquid $CO_2$ is dropped to atmospheric pressure the quantity of solid $CO_2$ produced will be about 10% greater than that produced from the same pressurized liquid $CO_2$ without subcooling, i.e., at a temperature of 0° F. Obviously, it is advantageous to fill the tubular container with subcooled pressurized liquid $CO_2$ whenever a supply source is available.

The advantage of introducing liquid $CO_2$ from a supply source at a pressure in the range of 215 to 305 psia into the container while maintained at a lower pressure above the triple point of $CO_2$ is that the $CO_2$ vapor evolved during the filling of the container can be recompressed and liquefied more economically than recompressing and liquefying $CO_2$ vapor evolved at atmospheric pressure. It clearly takes more energy and equipment to compress and liquefy $CO_2$ vapor at atmospheric pressure than it does to compress and liquefy $CO_2$ vapor above the triple point, e.g., at 79 psia.

Variations and modifications of the invention will be apparent to those skilled in the art. For instance, the tubular metal container may be in the form of a hairpin or U-tube so that the inlet and outlet of the container are next to each other. Such a U-tube container may be less expensive than two tubes connected by headers at their opposite ends. The tubular container need not be cylindrical; for example, it may have an elliptical transverse section. Accordingly, only such limitations should be imposed on the scope of the invention as are set forth in the appended claims.

What is claimed is:

1. The method of storing refrigeration in the form of solid $CO_2$ in a chamber requiring refrigeration, which comprises supplying pressurized liquid $CO_2$ to a pressurizable horizontal tubular metal container through an opening close to the top of said container, said container being positioned adjacent the top of said chamber, stopping the supply of said liquid $CO_2$ before said container is completely filled, and opening a vent close to the top of said container to reduce the pressure therein to a pressure below the triple point of $CO_2$ to effect vaporization of part of said liquid $CO_2$ within said container and to allow $CO_2$ vapor to escape from said container, thereby effecting solidification of the remainder of said liquid $CO_2$ within said container.

2. The method of claim 1 wherein the pressurized liquid $CO_2$ is supplied at a pressure in the range of about 215 to 305 psia, and when the vent is opened the pressure is reduced to substantially atmospheric pressure.

3. The method of claim 2 wherein the pressurized liquid $CO_2$ is subcooled at least 10° F. when supplied to the container.

4. The method of claim 1 wherein, after the remainder of the liquid $CO_2$ has been solidified, the vent is closed, the supplying of pressurized liquid $CO_2$ to the container is resumed but stopped before said container is completely filled, and said vent is again opened to reduce the pressure in said container to effect vaporization of part of said liquid $CO_2$ therein and to allow $CO_2$ vapor to escape from said container, thereby effecting solidification of the remainder of said liquid $CO_2$ within said container.

5. The method of claim 1 wherein $CO_2$ vapor vented from the container is compressed and liquefied to form pressurized liquid $CO_2$ for supplying said container.

6. The method of claim 1 wherein the pressurized liquid $CO_2$ at a pressure in the range of about 215 to 305 psia enters the container at a reduced pressure above 76 psia, and when the vent is opened the pressure is further reduced to substantially atmospheric pressure.

7. The method of claim 6 wherein $CO_2$ vapor, evolved while the pressurized liquid $CO_2$ enters the container at a reduced pressure above 76 psia, is drawn from said container, is compressed and liquefied for supplying said container.

8. The method of claim 7 wherein $CO_2$ vapor, evolved when the vent is opened to reduce the pressure to substantially atmospheric pressure, is compressed and liquefied for supplying the container.

9. The method of claim 6 wherein, after the pressure has been further reduced to substantially atmospheric pressure, the vent is closed, pressurized liquid $CO_2$ at a pressure in the range of about 215 to 305 psia again enters the container at a reduced pressure above 76 psia, the supply of said liquid $CO_2$ is stopped before said container is completely filled, and said vent is again opened to atmospheric pressure.

10. The method of providing refrigeration in the form of solid $CO_2$ in a chamber requiring refrigeration, which comprises introducing pressurized liquid $CO_2$ into a horizontal tubular metal container maintained at a pressure above 76 psia through an inlet close to the top of said container, stopping the introduction of said liquid $CO_2$ when the liquid level is near said inlet, and opening an outlet close to said top of said container to drop the pressure therein to substantially atmospheric pressure to cause flashing of $CO_2$ vapor from said liquid $CO_2$ within said container and venting of said $CO_2$ vapor from said container, thereby solidifying the remainder of said liquid $CO_2$ within said container.

11. The method of claim 10 wherein the pressure maintained in the container during the introduction of liquid $CO_2$ is in the range of about 215 to 305 psia.

12. The method of claim 11 wherein the $CO_2$ vapor vented from the container is discharged into the chamber along the top of the walls of said chamber.

13. The method of claim 11 wherein the liquid $CO_2$ is subcooled at least 10° F. when introduced into the container.

14. A chamber for holding goods under refrigeration, which comprises a tubular metal container disposed horizontally adjacent the ceiling of said chamber, said container being capable of withstanding a pressure of at least 305 psia, a feed pipe connected close to the top of said container for supplying pressurized liquid $CO_2$ to said container, a valve in said feed pipe, a vent pipe for $CO_2$ vapor connected close to said top of said container, a valve in said vent pipe, and insulation on the exterior of said container to obtain at the exposed surface of said insulation a predetermined low temperature above −109° F.

15. The chamber of claim 14 wherein the vent pipe has branch pipes extending within said chamber along the top of the walls thereof, and said branch pipes have a series of spaced perforations to discharge $CO_2$ vapor into said chamber.

16. The chamber of claim 14 wherein the vent pipe has a pressure relief valve to maintain a predetermined back pressure in the container while $CO_2$ vapor is vented therefrom.

17. The chamber of claim 14 wherein a liquid sensor is disposed near the vent pipe to prevent entry of liquid $CO_2$ into said vent pipe.

18. The chamber of claim 14 wherein the insulation on the exterior of the container includes an insulation panel that may be removed to decrease the temperature in said chamber and returned to increase the temperature in said chamber.

* * * * *